US005497756A

United States Patent [19]

Matthiesen et al.

[11] Patent Number: 5,497,756

[45] Date of Patent: Mar. 12, 1996

[54] IGNITION COIL FOR AN INTERNAL COMBUSTION ENGINE

[75] Inventors: Klaus Matthiesen, Blaichach; Nikolaus Hautmann, Waltenhofen, both of Germany

[73] Assignee: Robert Bosch GmbH, Stuttgart, Germany

[21] Appl. No.: 367,696

[22] Filed: Jan. 3, 1995

[30] Foreign Application Priority Data

Feb. 17, 1994 [DE] Germany ..... 44 04 957.9

[51] Int. Cl.[6] ..... F02P 3/04; H01F 27/00

[52] U.S. Cl. ..... 123/634; 123/635; 336/90

[58] Field of Search ..... 123/634, 635, 123/647; 336/90, 96

[56] References Cited

U.S. PATENT DOCUMENTS

| | | | |
|---|---|---|---|
| 4,248,201 | 2/1981 | Tsutsui et al. | 123/634 |
| 4,446,842 | 5/1984 | Iwasaki | 123/634 |
| 4,926,152 | 5/1990 | Ito et al. | 336/90 |
| 5,032,814 | 7/1991 | Badaud | 336/65 |
| 5,241,941 | 9/1993 | Hancock et al. | 123/634 |
| 5,257,611 | 11/1993 | Chapekis et al. | 123/634 |
| 5,335,642 | 8/1994 | Hancock et al. | 123/634 |
| 5,357,233 | 10/1994 | Wada | 123/634 |
| 5,419,300 | 5/1995 | Maruyama et al. | 123/634 |

FOREIGN PATENT DOCUMENTS

| | | |
|---|---|---|
| 0395511 | 10/1990 | European Pat. Off. . |
| 418137 | 3/1991 | European Pat. Off. . |
| 4035163 | 5/1991 | Germany . |
| 9313533 | 7/1993 | WIPO . |

*Primary Examiner*—Willis R. Wolfe
*Attorney, Agent, or Firm*—Michael J. Striker

[57] ABSTRACT

An ignition coil for an internal combustion engine has a housing composed of synthetic plastic material, at least one main core provided with a coaxial primary and secondary coils, a return flux core surrounding the main core, a dome extending from the housing and having a high voltage connection connected with the secondary coil and associated with a spark plug of an internal combustion engine. The main core and the return flux core are composed of a plurality of coated lamellas. The return flux coil is provided with recesses extending through the lamellas for passage of mounting means for the ignition coil, the recesses each being coated with a bushing. The bushings are formed as synthetic plastic injection molded parts which are connected of one-piece with a synthetic plastic jacket of the return flux core.

8 Claims, 2 Drawing Sheets

IGNITION COIL FOR AN INTERNAL COMBUSTION ENGINE

BACKGROUND OF THE INVENTION

The present invention relates to ignition coils for internal combustion engines.

More particularly, it relates to an ignition coil which has a housing composed of synthetic plastic material and accommodating at least one main core surrounded by a return flux coil.

Ignition coils of the above mentioned general type are known in the art. In the known ignition coil the main core formed as a rod core is provided with a primary winding and a secondary winding, a flame-shaped return flux core surrounds the rod core, and a trough-shaped housing is composed of synthetic plastic material.

The return flux core which, as the main core, is composed of coated, soft magnetic lamellas is provided with two projections which are arranged in the diametrically opposite corners and formed as mounting ears. Each of the projections has a recess formed as an opening for mounting the ignition coil. The ignition coil is mounted on the cylinder head cover of the internal combustion engine by mounting means extending through the recesses, in particular screws or threaded pins.

During mounting or dismounting of the ignition coil the mounting means with the lamellas, and particularly the connecting lamellas engage on the upper and lower sides and these lamellas can be released from the remaining core lamellas and damaged. This can lead in undesirable manner to an operational disruption of the ignition coil.

It is further known to bundle the lamellas by a hollow rivet inserted in the recesses. This solution however has disadvantages. In particular, when there is a danger of radial narrowing of the throughgoing opening of the hollow rivet during the riveting process, the ignition coil can no longer be mounted. As a result, the hollow rivet is not placed in the form-locking manner on the connecting lamellas and in view of the high deformation cracks can occur at the flange of the hollow rivet. Therefore, setting takes place at the mounting connection extending through the hollow rivet under the action of dynamic loads, and the holding of the ignition coil is disrupted. Finally, the insertion of the hollow rivet into the recesses must be performed in a separate working step and its results must be tested in series manufacture which leads to high manufacturing costs of the ignition coil.

SUMMARY OF THE INVENTION

Accordingly, it is an object of the present invention to provide an ignition coil for internal combustion engines, which avoids the disadvantages of the prior art.

In keeping with these objects and with others which will become apparent hereinafter, one feature of the present invention resides, briefly stated, in an ignition coil which has a housing composed of a synthetic plastic material and accommodating at least one main core surrounded by a return flux core and having coaxial primary and secondary coils, with a dome extending from the housing and provided with high voltage connection associated with the secondary coil and an ignition core, with the main core and return flux core assembled of coated lamellas, and with the lamellas of the return flux core provided with throughgoing recesses for mounting means for the ignition coil, wherein in accordance with the present invention each of the recesses is coated with a bushing and the bushings are formed as synthetic plastic injection parts connected of one piece with a synthetic plastic jacket of the return flux core.

When the ignition coil is designed in accordance with the present invention it eliminates the above described disadvantages of the prior art.

The recesses in the return flux core are simply covered with a bushing, and the bushings are produced as plastic injection molded parts directly with the synthetic plastic jacket of the return flux core in a manner which is favorable for manufacture.

Because of the bushings, the contact of the mounting means with the lamellas of the return flux core in the region of the recesses is avoided, so that the ignition coil during mounting or dismounting is no longer damaged by bending of the lamellas. Since the bushings are formed as plastic injection molded parts, the manufacturing accuracy is such that the radial narrowing of the throughgoing opening of the bushings and setting of the bushings are avoided, and a reliable, durable of the ignition coil on the internal combustion engine is provided.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
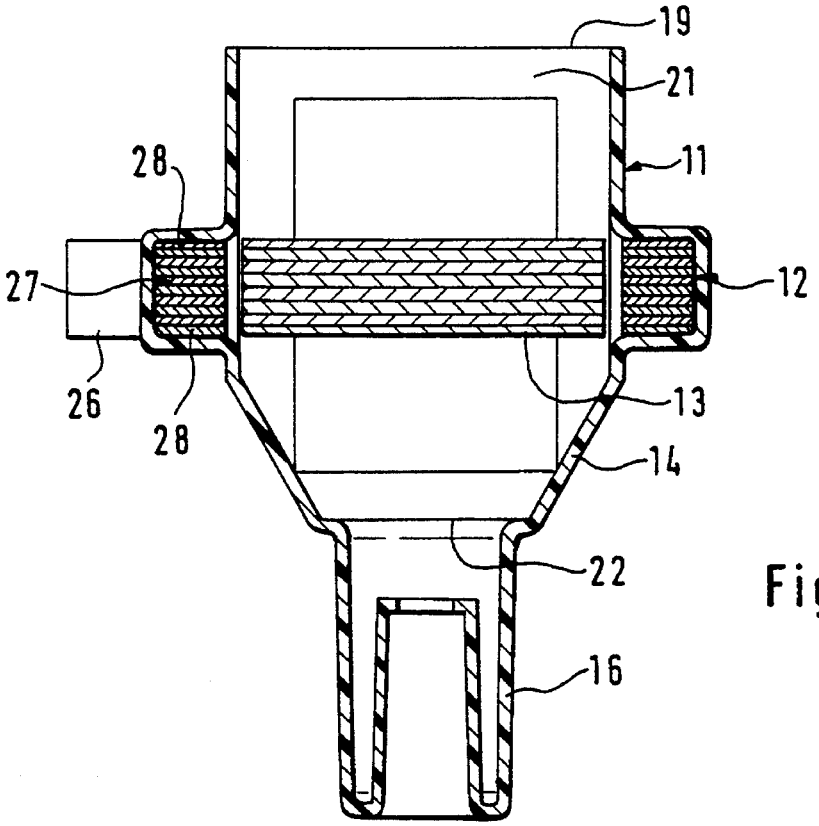
FIG. 1 is a view showing a longitudinal section of an ignition coil with several sectioned regions, in accordance with the present invention.
Figure 2:
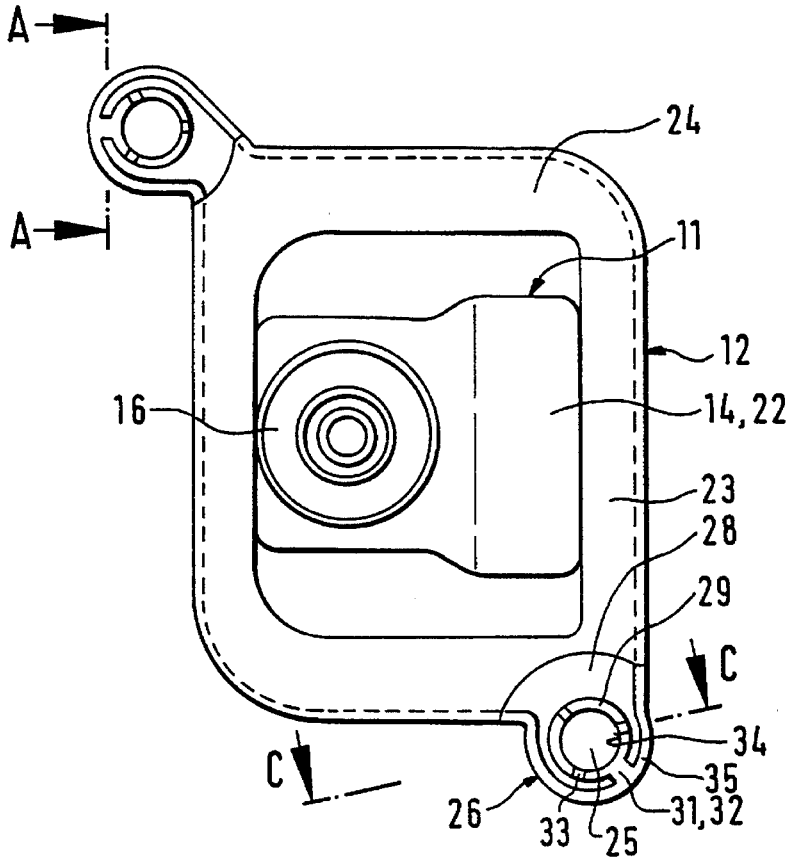
FIG. 2 is a view from below of the inventive ignition coil.

An ignition coil for an internal combustion engine shown in FIGS. 1 and 2 has a housing 11, a frame-shaped, closed return flux core 12 embedded in the housing 11, and a main core 13 which is surrounded by the return flux core 12 and formed as a rod core. The main core 13 is coaxially surrounded by a primary coil and a secondary coil each arranged on a coil body. A dome 13 which is a part of the housing 11 projects from a base body 14 of the housing 11. It is provided with a high voltage connection which is connected with the secondary coil and associated in a conventional manner with a not shown spark plug of the internal combustion engine.

The housing 11 is composed of a synthetic plastic material which is treated in an injection molding process. It surrounds the trough-shaped base body 14 which operates as a receiving part for the main core 13 with the windings surrounding the same.

The base body 14 is provided on its outer side with an inlet opening 19. A structural group which is formed from the main core 13 and the coils is inserted through the inlet opening 19 into an inner chamber 21 of the base body and enclosed with casting resin. The base body 14 is closed at its lower side with a bottom 22. The sleeve-shaped dome 16 extends from the bottom 22 in spatial association with the windings mounted on the rod core 13.

Figure 3:
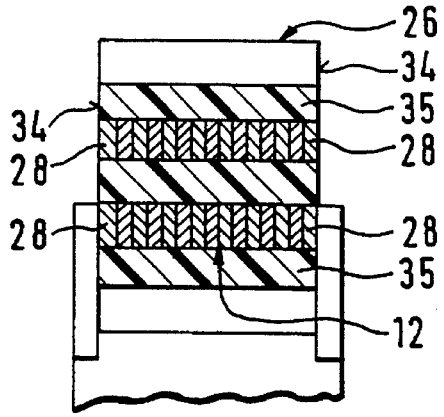
FIG. 3 is a view showing a projection of a return flux core of the ignition coil in longitudinal section along the line A—A in FIG. 2.

The return flux core 12 has a basic form as a substantially rectangular frame provided with two longitudinal legs 23 and two transverse legs 24. Two projections 24 formed as mounting ears extend from diagonally opposite corners and are each provided with a recess formed as an opening 25. The return flux core 12 as well as the main core 13 are composed of coated lamellas 27 of soft iron, each connected with a connecting lamella 28 of the upper and lower sides of the return flux core 12. As shown in FIGS. 2 and 3, the return flux core 12 is completely surrounded in an injection molding process in one working step with the production of the housing 11 up to the end surfaces 34 of the projections 26, with a synthetic plastic jacket 35, and by a gradual inclusion into the wall of the housing 11 forms its supporting element.

Each of the openings 25 formed as throughgoing openings is covered with a substantially cylindrical bushing 29 of a synthetic plastic material. At their end sides, the bushings are connected with the connecting lamellas 28. The bushing 29 has a web 31 which extends from its outer surface over its longitudinal extension. When the radially directed slot 22 extending through the wall of the projection 26 is filled, the web 31 connects the bush 21 with the synthetic plastic jacket 35 of the return flux core 12 and thereby also is connected as one piece with the housing 11.

Figure 4:
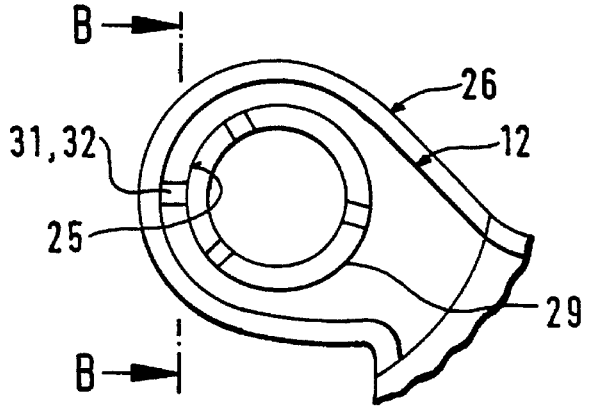
FIG. 4 is a view showing an alternative construction of the above mentioned projection.
Figure 5:
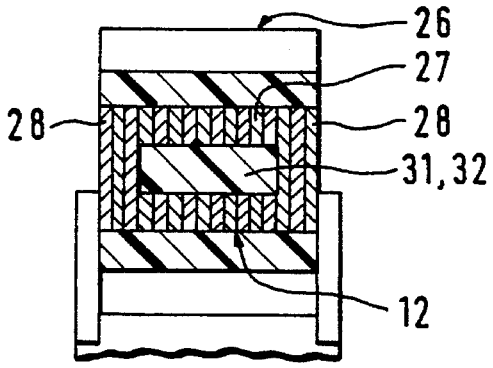
FIG. 5 is a view showing a longitudinal section of the projection taken along the line B—B in FIG. 4.

In an alternative embodiment shown in FIGS. 4 and 5, the return flux core 12 is provided in the region with the recesses 25 with a radially extending slot 32 which however extends over the inner lamellas 27 located between the connecting lamellas 28. In an alternative solution, two further lamellas 27 located near the connecting lamellas 28 are not slotted. Thereby these non slotted lamellas 27, 28 surround the bushing 29 and are especially stable. The remaining web 31 has a smaller cross-sectional area than in the embodiment of FIGS. 2 and 3, but sufficient for the injection molding process.

Figure 6:
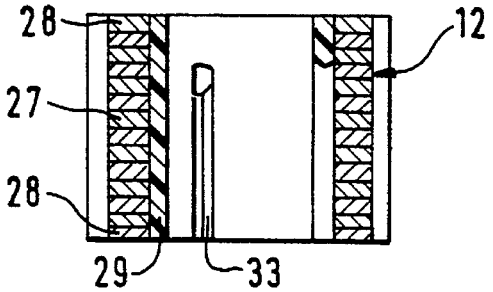
FIG. 6 is a view showing a longitudinal section of the projection taken along the line C—C in FIG. 2.

Several, longitudinally extending grooves 33 are provided on the inner surface of each of the bushings 29 as shown in FIG. 6. They separate the walls of the bushings 29 and extend over a partial length of the bushings 29. The grooves 33 make possible forming of centering cams of an injecting molding tool, so as to provide a position accuracy of the corresponding inner surface of the bushing 29, so as to provide the correct positioning of the ignition coil during its mounting.

During mounting the ignition coil is screwed by screws extending through the bushing 29 on a cylinder head cover of the internal combustion engine. During the screwing process each of the screws is guided inside the corresponding bushing 29 so that an interlocking of the screws with the lamellas 27 and 28 and a deformation of the return flux core 12 cannot occur. This is true for the dismounting of the ignition coil, which is required for example for exchange of the associated spark plug.

Alternatively, the mounting of the ignition coil of the internal combustion engine can be performed by nuts cooperating with stay bolts which extend through the bushings 29 and fixed on the cylinder head cover.

In both cases, the bushings 29 provide a cost favorable protection of the lamellas 27 in particular the connecting lamellas 28, from damaging during mounting.

It will be understood that each of the elements described above, or two or more together, may also find a useful application in other types of constructions differing from the types described above.

While the invention has been illustrated and described as embodied in an ignition coil for an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. An ignition coil for an internal combustion engine, comprising a housing composed of synthetic plastic material; at least one main core provided with coaxial primary and secondary coils; a return flux core surrounding said main core; a dome extending from said housing and having a high voltage connection connected with said secondary coil and associated with a spark plug of an internal combustion engine, said main core and said return flux core being composed of a plurality of coated lamellas, said return flux core being provided with recesses extending through said lamellas for passage of mounting means for the ignition coil, said recesses each being coated with a bushing, said bushings being formed as synthetic plastic injection molded parts which are connected of one-piece with a synthetic plastic jacket of said return flux core.

2. An ignition coil as defined in claim 1, wherein said bushings are provided with grooves which extend over a partial length of said bushings.

3. An ignition coil as defined in claim 1, wherein said synthetic plastic jacket is formed of one piece with said housing.

4. An ignition coil as defined in claim 1, wherein said bushings have outer webs with which said bushings are connected with said synthetic plastic jacket.

5. An ignition coil as defined in claim 4, wherein said webs are formed in said lamellas by slots which form passages for a synthetic plastic material between said bushings and said synthetic plastic jacket.

6. An ignition coil as defined in claim 5, wherein said recesses are formed as openings which extend through said return flux core, said slots extending in direction of said openings.

7. An ignition coil as defined in claim 5, wherein said slots extend through all of said lamellas.

8. An ignition coil as defined in claim 5, wherein said lamellas include inwardly located lamellas and also connecting lamellas extending from an end side of said return flux core, said slots extending only through said inwardly located lamellas and ending in an axial direction before said connecting lamellas.

* * * * *